US011616316B2

(12) United States Patent
Dullin et al.

(10) Patent No.: US 11,616,316 B2
(45) Date of Patent: Mar. 28, 2023

(54) SOCKET CONTACT ELEMENT FOR AN ELECTRICALLY CONDUCTIVE CONNECTION

(71) Applicant: Amphenol-Tuchel Electronics GmbH, Heilbronn (DE)

(72) Inventors: Claus Dullin, Bad Rappenau (DE); Uwe Käpplinger, Ahorn (DE); Manuel Keim, Weinsberg (DE)

(73) Assignee: AMPHENOL-TUCHEL ELECTRONICS GMBH, Heilbronn (DE)

( * ) Notice: Subject to any disclaimer, the term of this patent is extended or adjusted under 35 U.S.C. 154(b) by 0 days.

(21) Appl. No.: 17/286,291

(22) PCT Filed: Oct. 18, 2019

(86) PCT No.: PCT/EP2019/078361
§ 371 (c)(1),
(2) Date: Apr. 16, 2021

(87) PCT Pub. No.: WO2020/079219
PCT Pub. Date: Apr. 23, 2020

(65) Prior Publication Data

US 2021/0359452 A1 Nov. 18, 2021

(30) Foreign Application Priority Data

Oct. 18, 2018 (DE) ..... 10 2018 125 964.6

(51) Int. Cl.
*H01R 13/11* (2006.01)
*H01R 4/18* (2006.01)
*H01R 43/16* (2006.01)

(52) U.S. Cl.
CPC ..... *H01R 13/11* (2013.01); *H01R 4/185* (2013.01); *H01R 43/16* (2013.01)

(58) Field of Classification Search
CPC ..... H01R 13/11; H01R 4/185; H01R 43/16
(Continued)

(56) References Cited

U.S. PATENT DOCUMENTS 5,897,405 A * 4/1999 Endo ..... H01R 13/11 439/852
7,048,582 B2 * 5/2006 Tabata ..... H01R 43/16 439/852

(Continued)

FOREIGN PATENT DOCUMENTS

CN 107210543 A 9/2017
DE 198 12 935 A1 10/1998

(Continued)

OTHER PUBLICATIONS

Office Action issued in Chinese Patent Application No. 201980069040.2; Application Filing Date Oct. 18, 2019; dated Nov. 14, 2022 (9 pages).

*Primary Examiner* — Peter G Leigh
(74) *Attorney, Agent, or Firm* — Cantor Colburn LLP

(57) ABSTRACT

The invention relates to a socket contact element for establishing an electrically conductive connection including a crimp section for establishing an electrically conductive connection to a line and a contact box for establishing a detachable electrically conductive connection to a contact box plug, wherein the socket contact element is constructed in one piece and includes a plurality of integrally implemented functions based on geometrical designs. Furthermore, the invention relates to a sheet-shaped semifinished product for producing a socket contact element and the production method by forming.

14 Claims, 15 Drawing Sheets

(58) Field of Classification Search
USPC ..... 439/867
See application file for complete search history.

(56) References Cited

U.S. PATENT DOCUMENTS

| | | | | |
|---|---|---|---|---|
| 8,241,077 | B2 * | 8/2012 | Suzuki | H01R 13/114 439/852 |
| 10,276,959 | B2 | 4/2019 | Lehner et al. | |
| 10,297,940 | B2 * | 5/2019 | Tanikawa | H01R 13/113 |
| 10,355,374 | B2 * | 7/2019 | Kitamura | H01R 4/185 |
| 2018/0083380 | A1 | 3/2018 | Goto | |
| 2018/0219315 | A1 | 8/2018 | Kitamura et al. | |
| 2019/0013594 | A1 * | 1/2019 | Kitamura | H01R 11/11 |

FOREIGN PATENT DOCUMENTS

| | | | | |
|---|---|---|---|---|
| DE | 10 2005 033 696 | A1 | 3/2006 | |
| DE | 102005033696 | A1 * | 3/2006 | H01R 13/187 |
| DE | 10 2006 027 674 | B3 | 1/2008 | |
| DE | 102015201635 | A1 * | 8/2016 | H01R 13/11 |
| DE | 10 2015 209 119 | A1 | 11/2016 | |
| DE | 102015209119 | B4 * | 7/2017 | H01R 13/11 |
| WO | WO 2012/069499 | A1 | 5/2012 | |
| WO | WO-2012069499 | A1 * | 5/2012 | H01R 13/113 |

* cited by examiner

Schnitt A-A

Schnitt B-B

SOCKET CONTACT ELEMENT FOR AN ELECTRICALLY CONDUCTIVE CONNECTION

RELATED APPLICATIONS

This application is a national stage application of International Application No. PCT/EP2019/078361, filed Oct. 18, 2019, which is related to and claims priority to German Patent Application No. 10 2018 125 964.6, filed Oct. 18, 2018, the entire disclosures of which are hereby incorporated by reference.

The invention relates to a socket contact element for establishing an electrically conductive connection including a crimp section for establishing an electrically conductive connection to a line and a contact box for establishing a detachable electrically conductive connection to a contact box plug. Furthermore, the invention relates to a sheet-shaped semifinished product for producing a socket contact element and the production method by forming.

Electrical contact elements, contact arrangements, pluggable and detachable cable connecting elements, and production methods suitable for this purpose are available in the known prior art. Socket or contact elements can be designed as crimp contacts. In the connecting technology for electrical contacting tasks, crimp contacts are designed as elements having tabs, the tab ends of which are bent around the electrical conductor and simultaneously compressed with it. This available connecting technology is referred to as crimping. The forming and compressing procedures required for this purpose are frequently characterized by a semifinished product provided for this purpose, which is provided as non-crimped or pre-crimped starting material and forms the later contact element. To implement the crimping, the semifinished product is frequently placed on the anvil of a crimping tool. Subsequently, the electrical conductor or a stripped section of the electrical conductor is placed on the contact element. The at least one crimp tab is then bent around the stripped section and compressed with it in order to establish a mechanically stable and electrically conductive contact between the contact element and the electrical conductor.

Depending on the area of use, different, partially cumulative demands are placed on crimp connections—examples: mechanical strength, fatigue strength, low-resistance transmission of electrical energy, corrosion resistance, gas and liquid tightness.

In addition to the crimp contacts having their functional task of attaching feed lines, cables, or comparable—usually current-conducting—lines to contact elements, a variety of further demands are placed on contacting components. For this reason, in addition to the crimp connecting regions, there are further body-type parts within the contacting components, which are implemented integrally or separately. Examples of these are clamping and guiding elements, sockets, terminal parts, etc.

Known methods for producing contacting components are in particular stamping and forming processes. First a flat is severed from a sheet material by a stamping step or also more generally by a separation step. The flat is provided in a suitable way with contours which assist forming toward the contacting element and its defined functions. The flat semifinished product provided in this way is subsequently refined in one or more forming steps. Possible forming procedures can be implemented by folding, bending, pressing, deep-drawing, or the like.

Other production options for contacting elements can be carried out by sintering procedures, additive manufacturing methods, or by cutting or chip-removing machining.

The combination of the methods stamping and forming of a sheet-shaped starting material is an inexpensive and reliable way of providing contacting components in large piece counts, but is limited due to the restricted geometric shaping in the integration of various functions into one-piece contacting components and in particular socket contact elements.

To alleviate this disadvantage, the integrally implemented functions are limited or reduced in order to decrease the complexity of the component and/or the contacting components are embodied in multiple parts. Additive manufacturing methods, for example 3D printing or stereolithography, also come into consideration, but these have only limited suitability for mass production, are economically disadvantageous, and are limited with respect to processable materials.

It is the object of the invention to at least partially reduce the above-mentioned disadvantages and to provide a one-piece socket contact element having a plurality of integrative functions.

As a solution, the invention proposes a socket contact element for establishing an electrically conductive connection including a crimp section for establishing an electrically conductive connection to a line and a contact box for establishing a detachable electrically conductive connection to a contact box plug, wherein the socket contact element is constructed in one piece and includes a plurality of integrally implemented functions based on geometric designs. Furthermore, the invention proposes a sheet-shaped semifinished product for producing a socket contact element and the production method by forming.

The invention recognizes that the geometrical complexity of the flat material as a semifinished product for one-piece socket contact elements and/or the suitable forming sequence are capable of increasing the number of integral functions. In the specific case, the invention also considers elastic material properties and the outcomes that result during the forming and stamping processes with respect to burr formation and oblique stamped edges in the flat thickness direction.

A further aspect of the invention is to adapt the geometrical contour of the semifinished product as a result of the stamping process both with respect to the achievable dimensional accuracies and also the—preferably metallic and/or at least electrically conductive—material properties with respect to deformability, elasticity, and strength.

The invention is explained in greater detail hereinafter on the basis of a preferred exemplary embodiment in conjunction with the figures. In the figures:

FIGS. 1*a*, 1*b* show the first and second perspective view of an exemplary embodiment of the socket contact element;

FIGS. 2*a*, 2*b* show the third and fourth perspective view of an exemplary embodiment of the socket contact element;

FIGS. 3*a*, 3*b* show the fifth and sixth perspective view of an exemplary embodiment of the socket contact element;

FIGS. 4*a*, 4*b* each show a perspective view of the contact box of an exemplary embodiment of the socket contact element;

FIGS. 5*a*, 5*b* show a first side view and a first top view of the exemplary embodiment of the socket contact element;

FIGS. 6*a*, 6*b* show a second side view and a second top view of the exemplary embodiment of the socket contact element;

FIGS. 7*a*, 7*b* show a first and a second frontal view of the exemplary embodiment of the socket contact element;

FIGS. 8*a*, 8*b* each show a sectional illustration of the contact box of an exemplary embodiment of the socket contact element;

FIGS. 9*a*, 9*b* show the first perspective sectional illustration of an exemplary embodiment of the socket contact element as a whole and its contact box;

FIG. 10*a* shows the second perspective sectional illustration of an exemplary embodiment of the socket contact element as a whole and its contact box;

FIG. 10*b* shows the second perspective sectional illustration of an exemplary embodiment of the socket contact element comprising the detail of the contact box;

FIG. 11*a* shows the sectional illustration A-A of the contact box of the socket contact element at the height of the closure tab with stop;

FIG. 11*b* shows the sectional illustration B-B of the contact box of the socket contact element at the height of the detent hook head of the detent hook;

FIG. 12*a* shows the sectional illustration C-C of the contact box of the socket contact element at the height of the support lug of the closure tab with detent hook;

FIG. 12*b* shows the sectional illustration D-D of the contact box of the socket contact element at the height of the closure tab and contact zone;

Figure 1A:
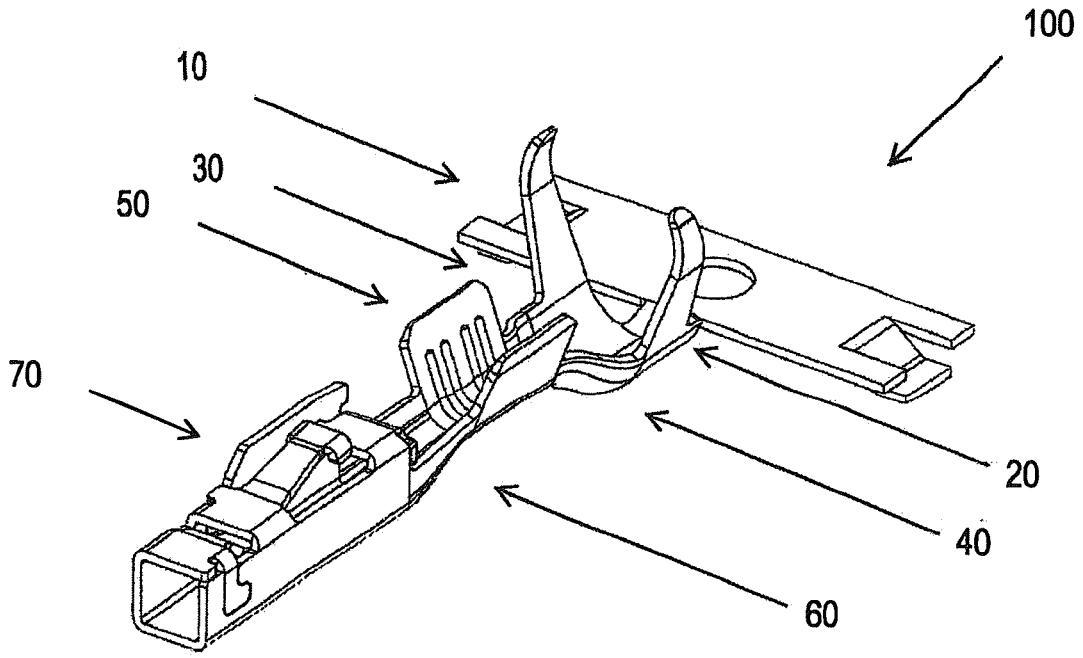
Figure 1B:
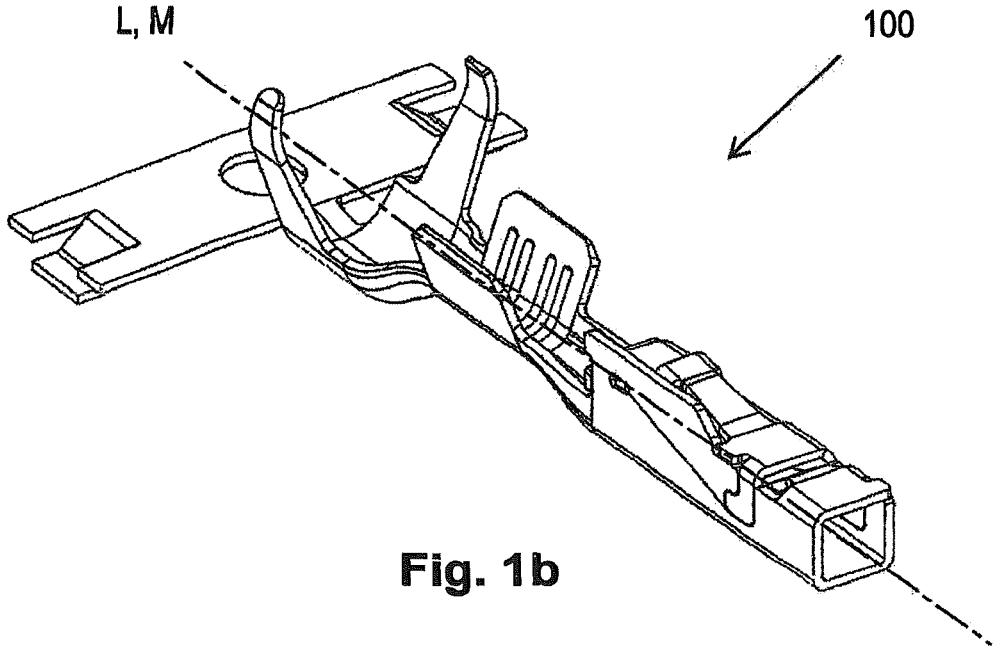

FIG. 1*a* and FIG. 1*b* depict a first and a second perspective view of an exemplary embodiment of the socket contact element 100. The preferably one-piece element extends in the direction of a longitudinal axis L, which is also the axis of symmetry or center axis M in regions of a symmetrical formation. The invention provides that integral functions are implemented through and possibly within regions. In FIG. 1, the socket contact element 100 is shown having a plurality of regions 10, 20, 30, 40, 50, 60, 70, the sequence of which is implemented in a longitudinal extension.

Figure 2A:
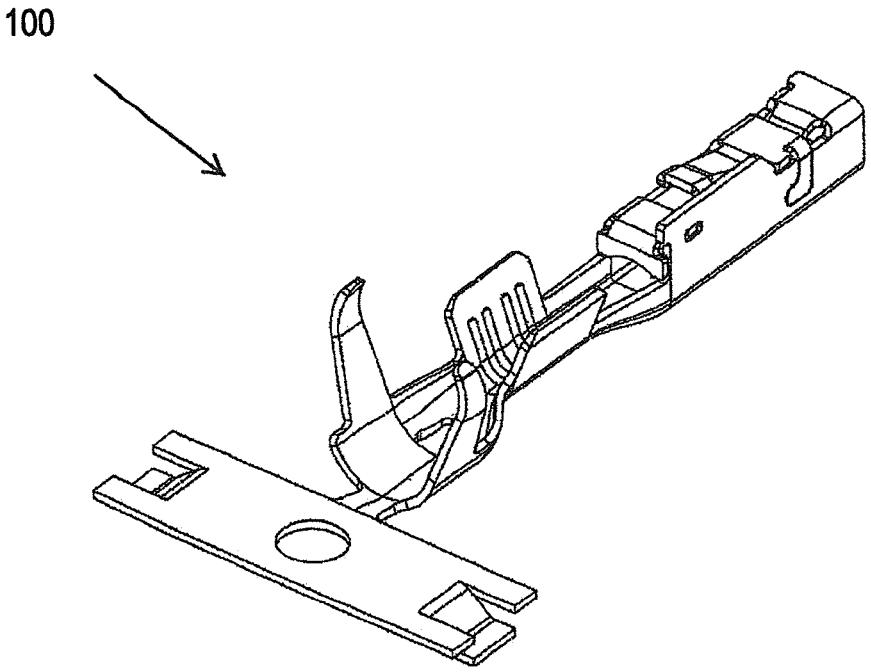
Figure 2B:
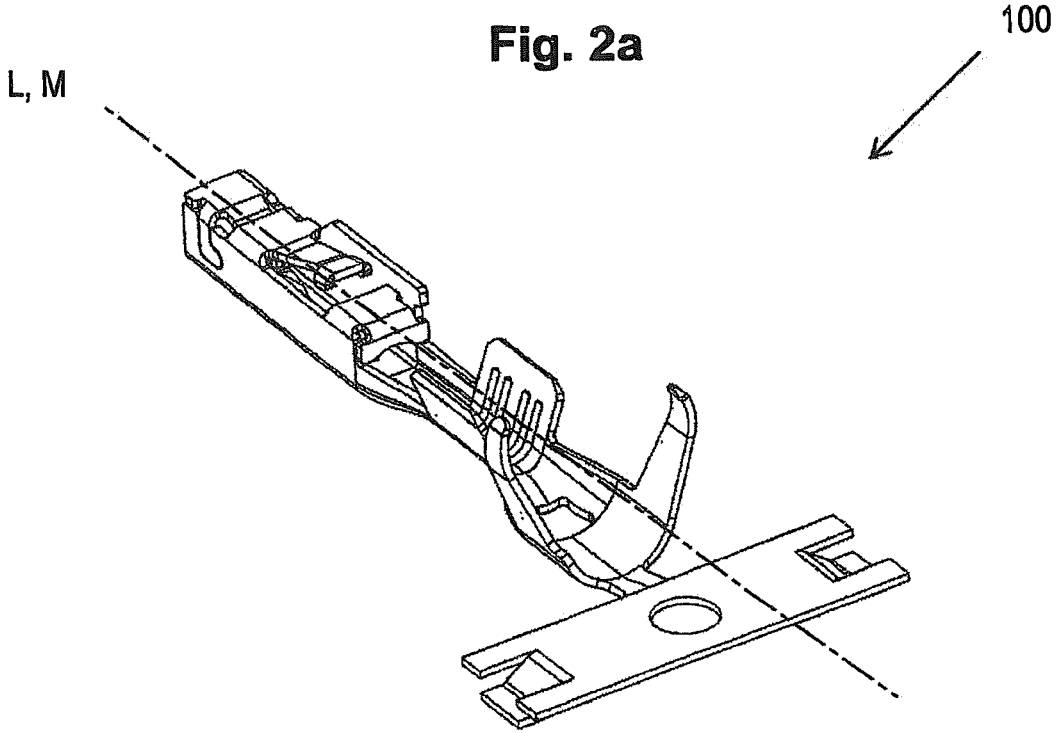
Figure 3A:
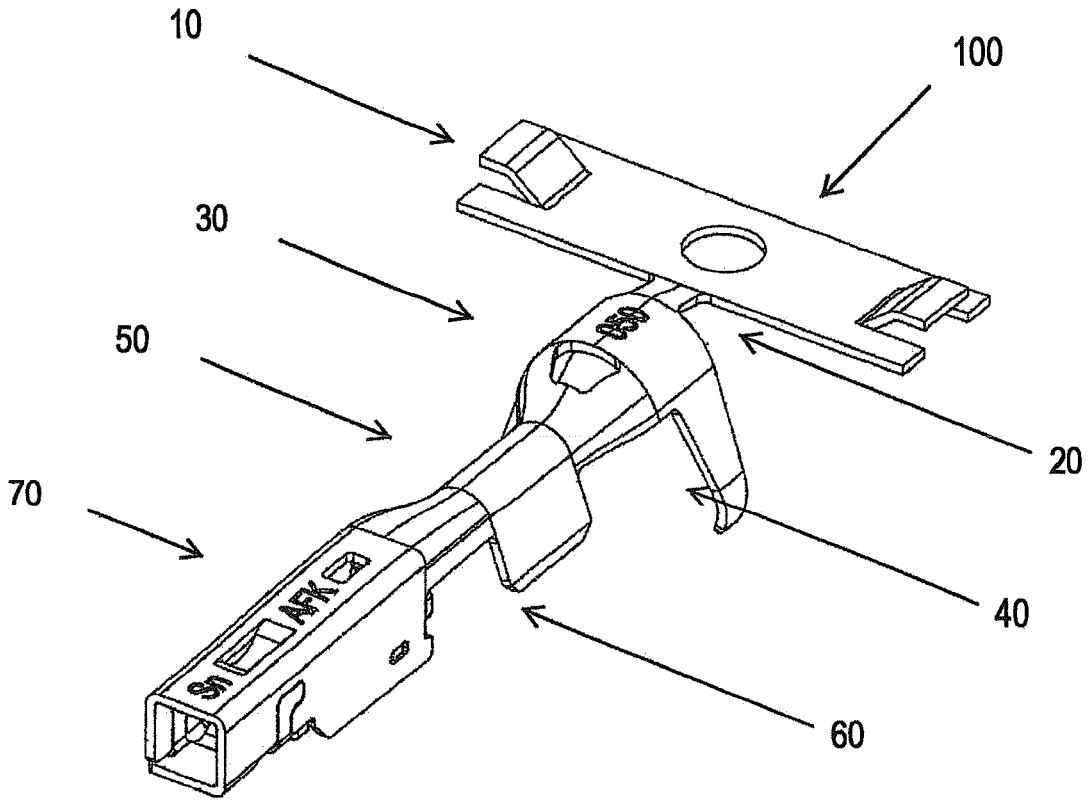
Figure 3B:
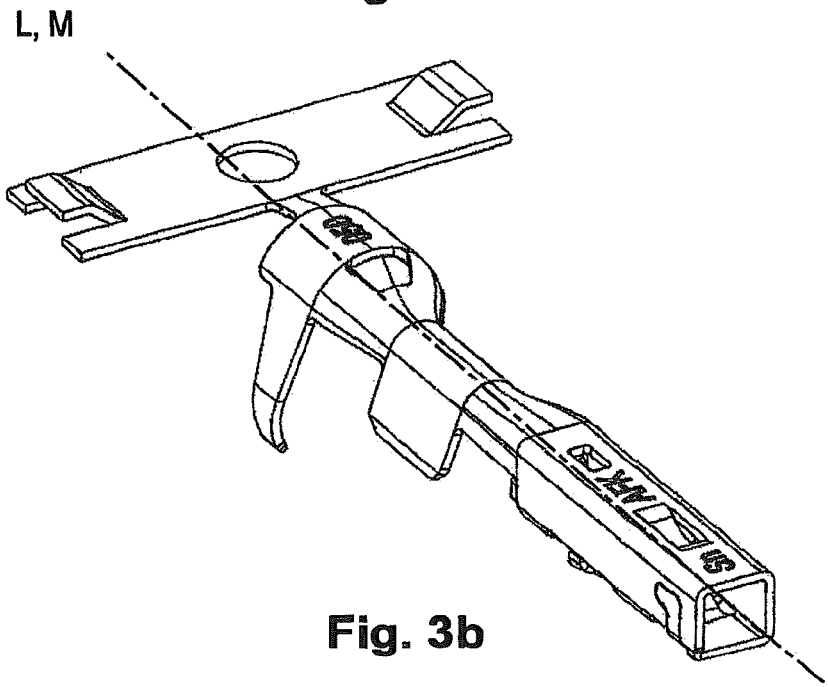

FIG. 2*a* and FIG. 2*b* depict a third and fourth and FIGS. 3*a* and 3*b* depict a fifth and sixth three-dimensional view of an exemplary embodiment of the socket contact element 100.

Figure 4A:
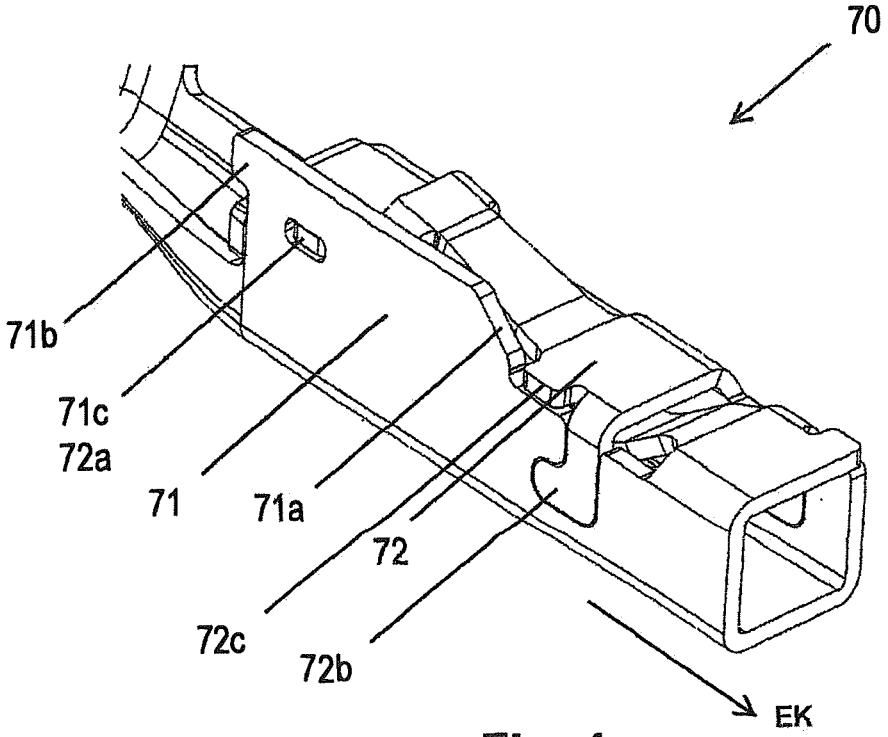
Figure 4B:
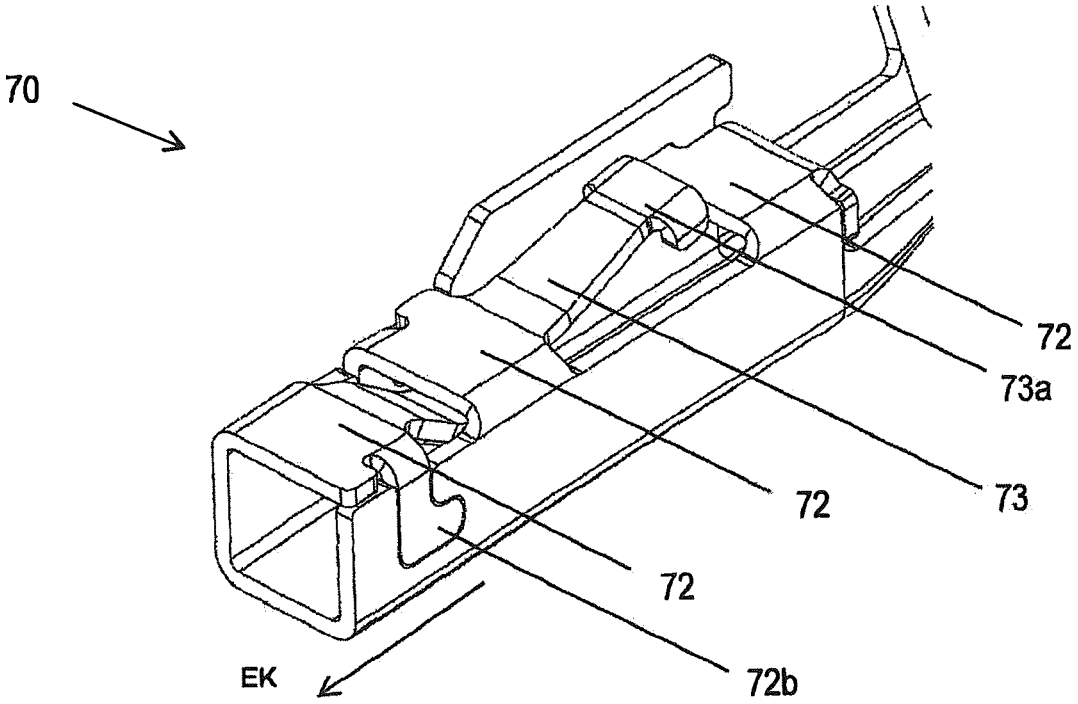

FIG. 4*a* and FIG. 4*b* each illustrate a perspective view of the contact box 70 in an exemplary embodiment of the socket contact element 100. The contact box 70 has a plurality of integrally implemented functions in the example shown. In particular guide and spring elements are provided both on the outside and also on the inside.

An orientation lip 71 is provided on the outside of the quadrilateral geometry of the contact box 70, which has a threading bevel, insertion chamfers 71*a* in the insertion direction of the socket contact element 100 into, for example, a contact carrier or multicontact block. The orientation lip 71 interacts geometrically with a correspondingly designed receptacle bore of a contact carrier or multicontact block in such a way that the installation is forced in only a correctly oriented position. The orientation lip 71 can be supplemented by a lug 71*b* on the longitudinal end face and against the insertion direction EK of the contact box 70. The lug 71*b* can functionally interact with the spring element of the contact carrier or multicontact block or can be used as a rear grip, for example. Furthermore, a bore 71*c* can be provided for receiving a closure lug 72*a* of the closure tab 72.

Furthermore, at least one closure tab 72 is provided to form the quadrilateral geometry of the contact box 70, which is brought into its position by a forming procedure, which is also called folding or bending, around a folding line parallel to the longitudinal axis L. A rear grip in a corresponding recess of the side wall of the contact box 70 or bore 71*c* of the orientation lip can assist the defined position fixing of the closure tab 72 by way of a closure lug 72*a* or a contoured closure lug 72*b*. The contoured closure lug 72*b* is preferably formed having its contoured part against the insertion direction EK of the contact box 70, so as not to form edges in the insertion direction which can be the cause of insertion problems of the contact box 70 into contact carriers or multicontact blocks.

Depending on the location and number of the integrated functions, a closure tab 72 can be supplemented by a support lug 72*c*, which can be formed geometrically comparable to the closure lug 72*a* and due to its design represents a contact shoulder on a side wall end face of the contact box 70 and comes to rest thereon. In this way, the strength and structural integrity of the overall construction is increased and simple movement limiting is provided during the forming process.

A detent hook 73, formed as a spring element, having its detent hook end oriented against the insertion direction EK of the contact box 70 is used for fixing the contact box 70 in position in the longitudinal direction after the insertion into the contact carrier or multicontact block. The detent hook head 73*a* can as shown have radially protruding wings, which correspond to a recess in the contact carrier or multicontact block or provide a tool engagement surface in order to assist bending back of the detent hook 73 and thus the removal of the contact box 70 from the contact carrier or multicontact block. Alternatively, the detent hook 73 can run out bluntly at the end if removal ability is not to be assisted. The detent hook tongue can be formed tapering toward the detent hook head for the targeted influencing of the spring property and spring or restoring force.

Figure 5A:
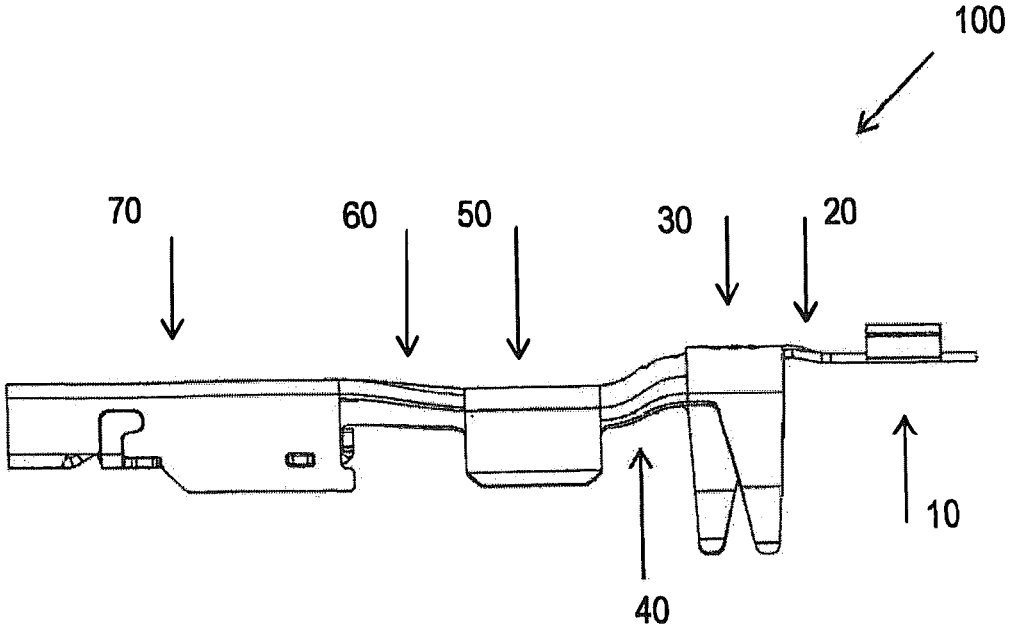

FIG. 5*a* depicts a first side view of the exemplary embodiment of the socket contact element 100.

Figure 5B:
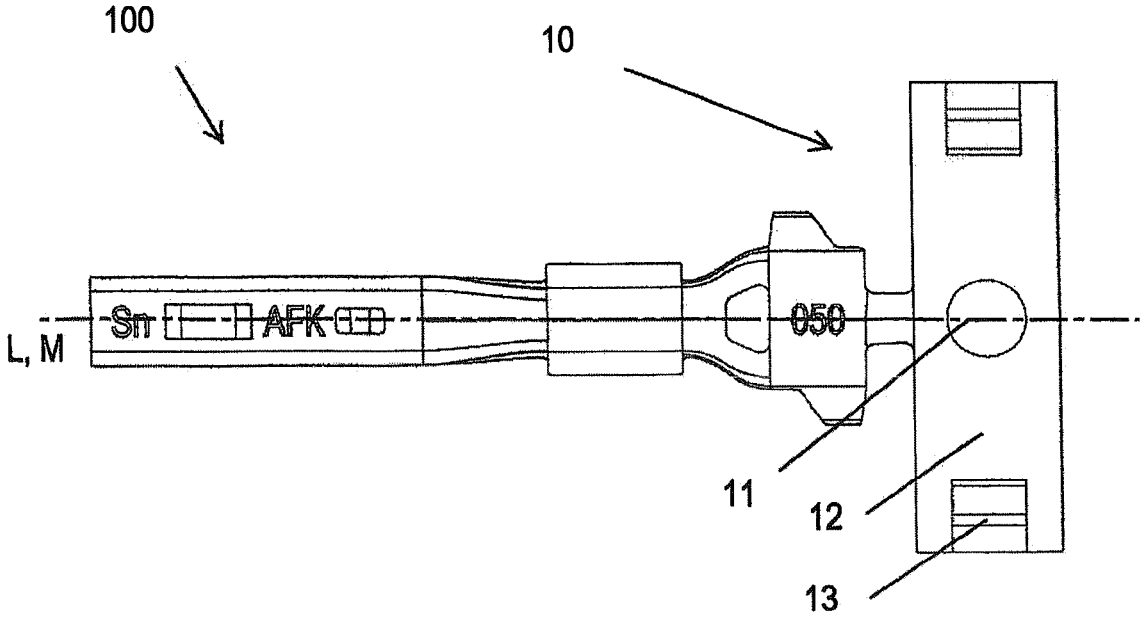

FIG. 5*b* shows the first top view of the exemplary embodiment of the socket contact element 100 similar to FIG. 5*a*. A handling section 10 is preferably provided at the end, which is formed by a section of the flat material and has a middle region having bore 11 adjoining the longitudinal axis L and at least one flat part 12 in the radial extension direction. In the radial end direction of the handling section 10, a notch 13 can optionally be provided, for example to implement a spring element or as a grip around an adjacent flat in the assembled state.

Figure 6A:
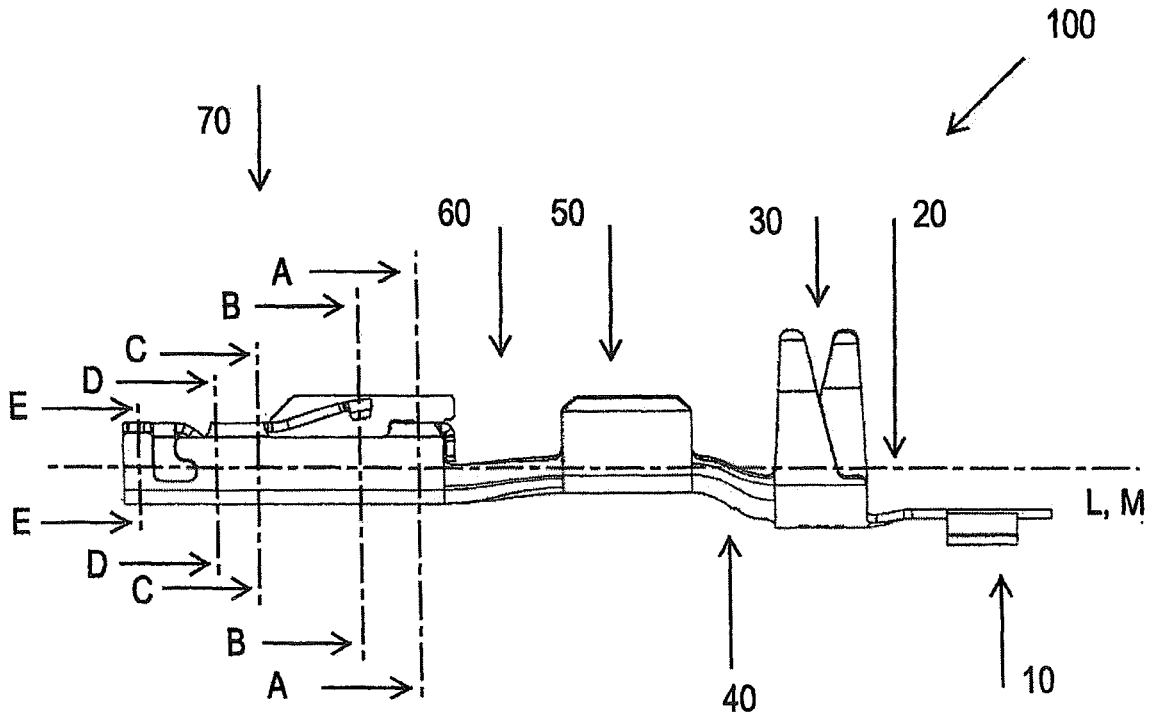

FIG. 6*a* depicts a second side view of the exemplary embodiment of the socket contact element 100. While the contact box 70 and the crimp section 50 are arranged aligned in the longitudinal direction with the center axis L, M, the insulation section 30 and the handling section 10 can have an offset axially parallel thereto. This offset is implemented by the deflection of the second connecting section 40 and/or the third connecting section 60. This offset is advantageous in particular with respect to the line guidance in the crimp section 50 and the insulation section 30, since buckling of the line core is avoided. This is achieved in that the amount of the offset is selected according to the wall thickness of the insulation material surrounding the line core of the line.

The insulation section 30 integrates a mechanical relief function for the crimp section into the socket contact element 100 in that mechanical loads—in particular tension—acting on an attached line (not shown) can be absorbed by the insulation section 30 and thus do not act on the crimp section 50. The insulation section can therefore also be referred to as a tension relief section.

Figure 6B:
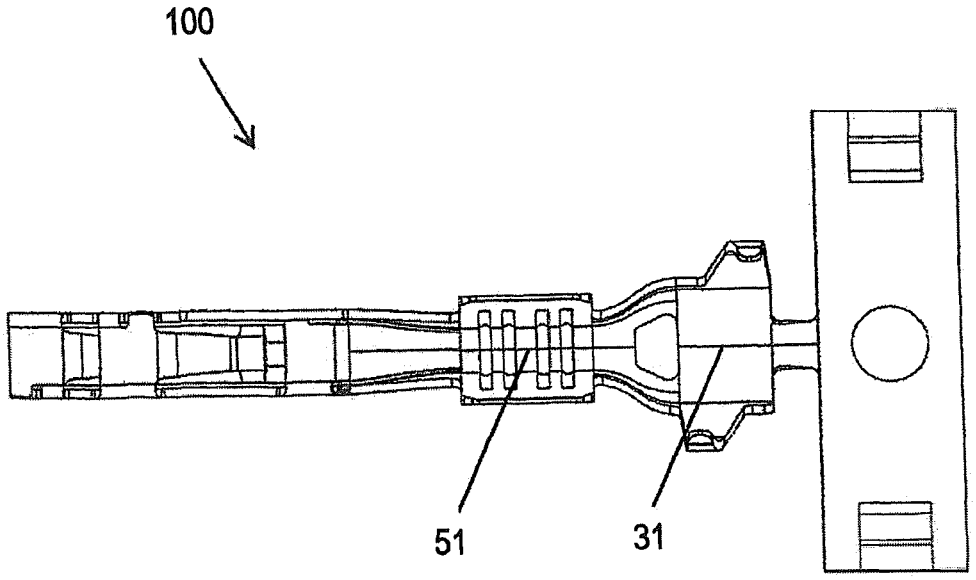

FIG. 6*b* shows the second top view of the exemplary embodiment of the socket contact element 100 similar to FIG. 6*a*. While the insulated line is arrangeable in the receptacle space 31 of the insulation section 30, the line core (stripped line) will come to rest in the receptacle space 51 of the crimp section 50. As a result, the line (not shown) to be crimped with the socket contact element 100 is fixable both aligned with the longitudinal axis L, M and also substantially reduced in buckling.

Figure 7A:
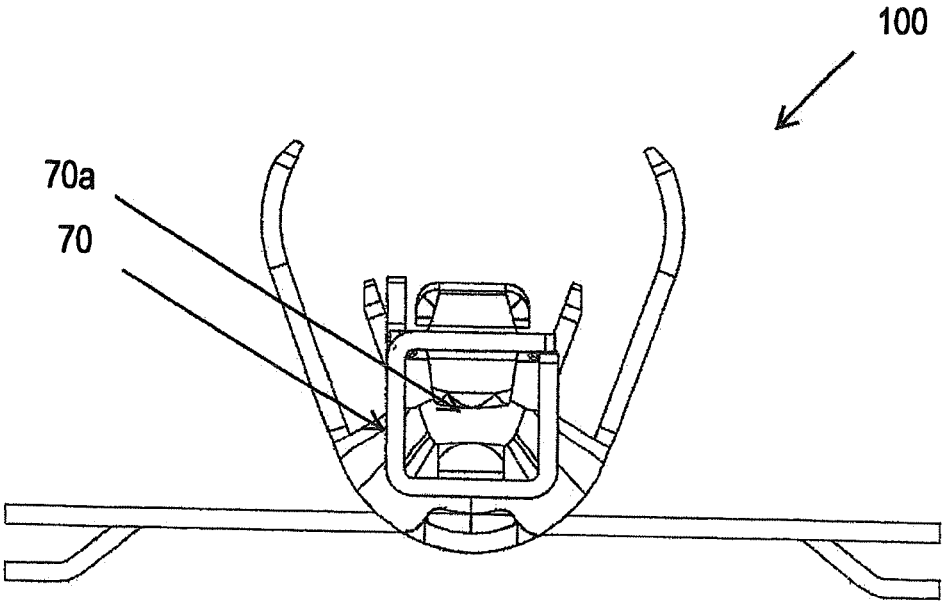

FIG. 7*a* shows the first frontal view of the exemplary embodiment of the socket contact element 100 on the end of the contact box 70 with its receptacle space 70*a* for a contact box plug. The quadrilateral space can have a square shape as shown, side edges of unequal length are also possible.

Figure 7B:
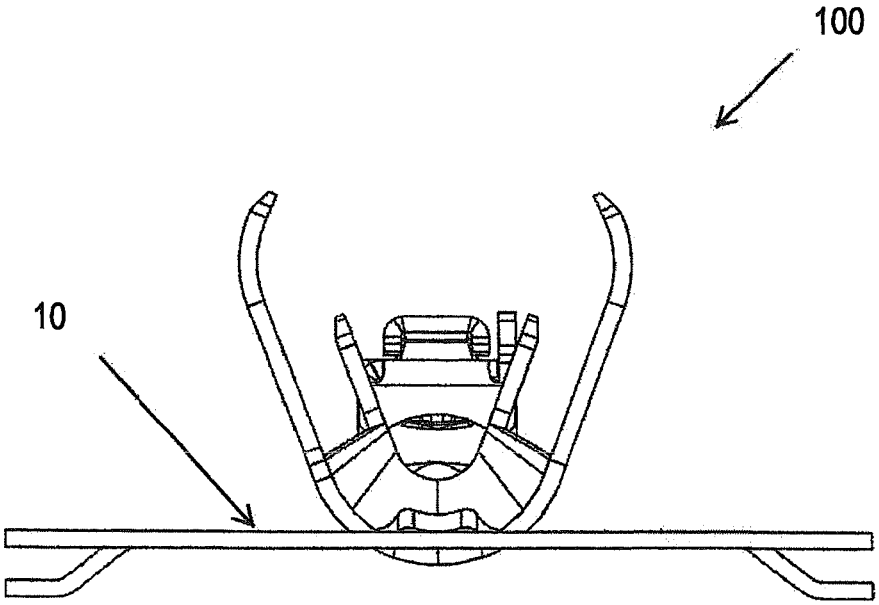

FIG. 7*b* shows the second frontal view of the exemplary embodiment of the socket contact element 100 on the end of the handling section 10.

Figure 8A:
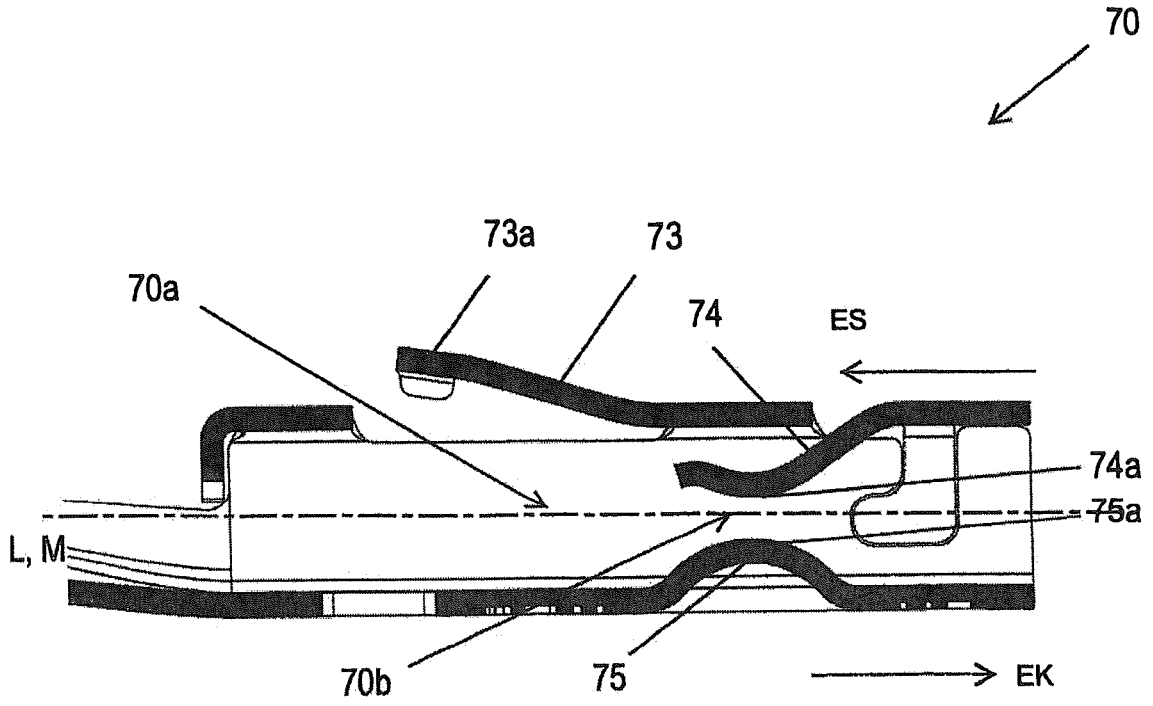
Figure 8B:
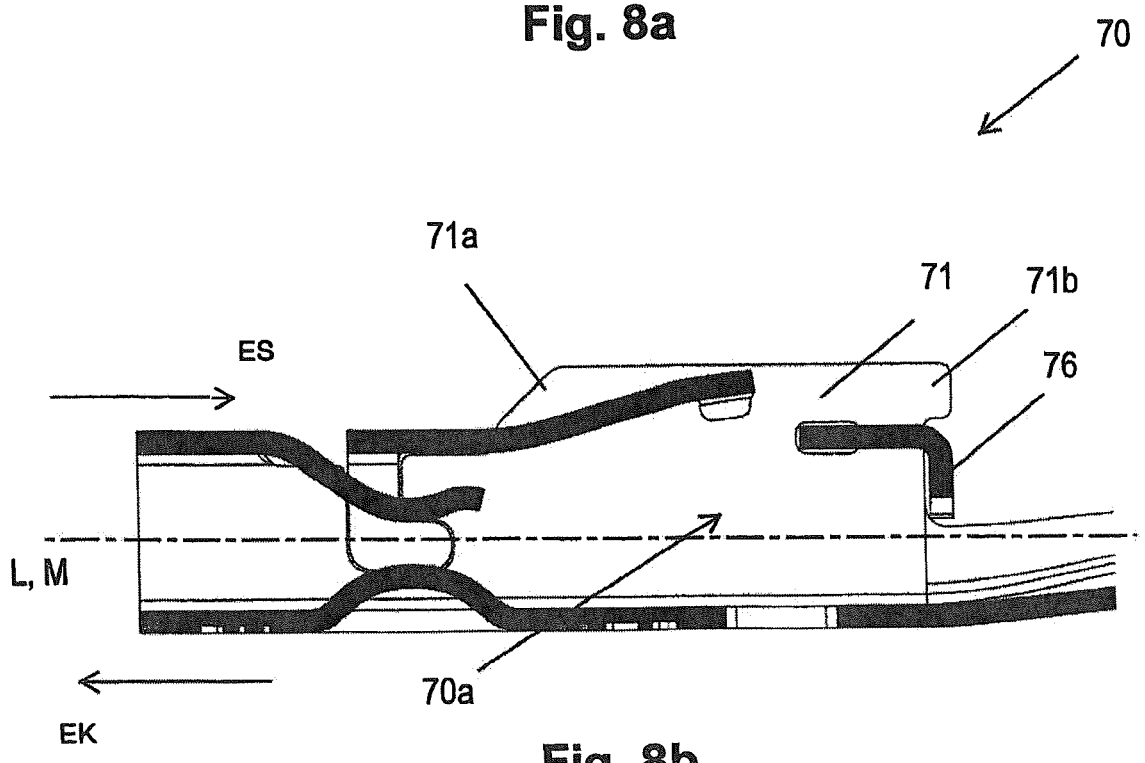

FIG. 8*a* and FIG. 8*b* each comprise a sectional illustration of the contact box 70 of an exemplary embodiment of the socket contact element 100. The interior of the contact box 70 formed as a receptacle space 70*a* for a contact box plug discloses further integrally implemented functions of the invention.

FIG. 8*a* shows the sectional illustration of the contact box 70 with its side facing away from the orientation lip 71. Inside the contact box 70, the receptacle space 70*a* is formed for an insertable contact box plug, which is physically and in particular electrically contactable with the contact box 70 at least in a contact zone 70*b*. While the side walls of the contact box 70 functionally effectuate the linear lateral guide for the contact box plug (not shown) to be introduced in the insertion direction ES, the contact zone 70*b* is formed or spatially delimited by a spring lip 74 and a contact arch 75.

In the present exemplary embodiment, the contact zone 70*b* is embodied symmetrically or axially symmetrically to the center axis L, M in the state of the inserted contact box plug.

The clearance of the contact zone 70*b* is, without inserted contact box plug, undersized relative thereto, so that a deflection of the spring lip 74 against its spring force takes place due to the insertion of the contact box plug and a clearance required for the contact box plug is released. The restoring force of the spring lip 74 presses the contact box plug at its contact surface 74*a* on the contact surface 75*a* of the contact arch 75.

The contact surfaces 74*a*, 75*a* are formed in regions as cylinder lateral surfaces, so that the following functional properties are assisted:

- The contact surfaces 74*a*, 75*a* each form a linear contact surface in relation to a planar contact box plug,
- The amounts of the linear contact surfaces are comparatively, so that an increased surface pressure is achievable,
- the increased surface pressure results in reliably keeping the contact partners in contact with one another,
- the formation of the contact surfaces 74*a*, 75*a* as cylinder lateral surfaces assists facilitated threading and insertion of the contact box plug into the receptacle space 70*a* and
- reduces the linear breaking loose force in the event of decontacting by pushing out the contact box plug against the direction ES.

FIG. 8*b* shows the sectional illustration of the contact box 70 with its side facing toward the orientation lip 71. To mechanically limit the insertion depth of the contact box plug into the receptacle space 70*a* of the contact box 70, the invention provides a stop 76 in the insertion direction ES on the front and end sides of the contact box 70. The stop can be formed as a bead or lug, so that a physical stopping element is formed for the contact box plug.

Figure 9A:
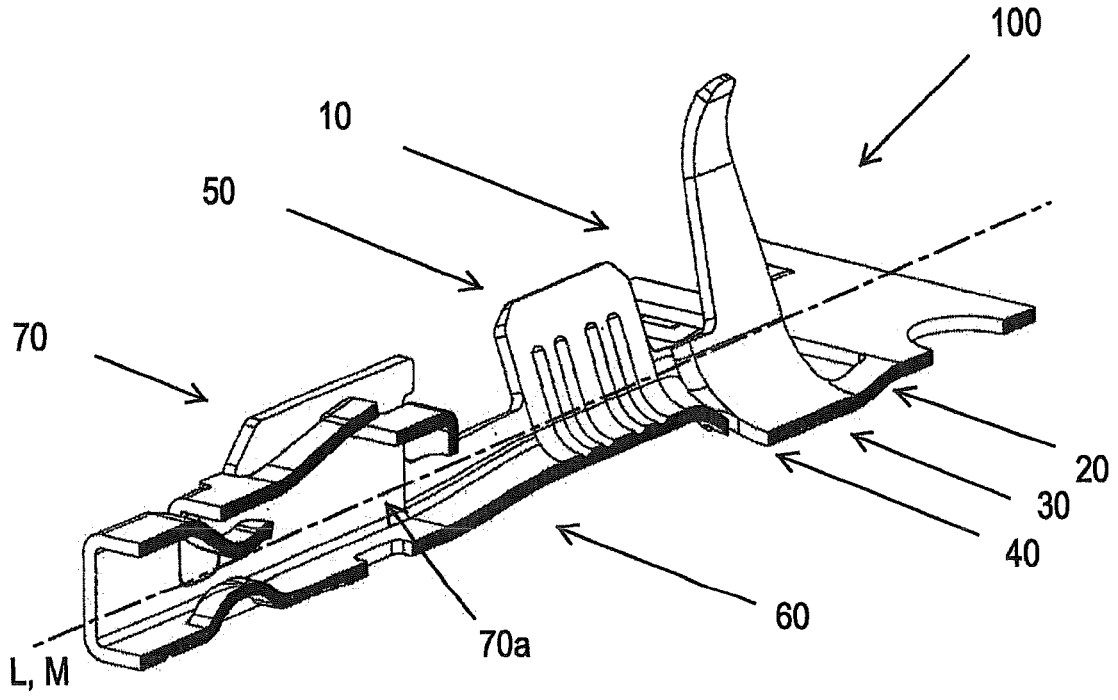

FIG. 9*a* comprises the first perspective sectional illustration of an exemplary embodiment of the socket contact element 100. The sectional plane arranged vertically at the height of the longitudinal or center axis L, M shows further functions or geometrical designs, which are preferably implemented integrally in one piece.

Figure 9B:
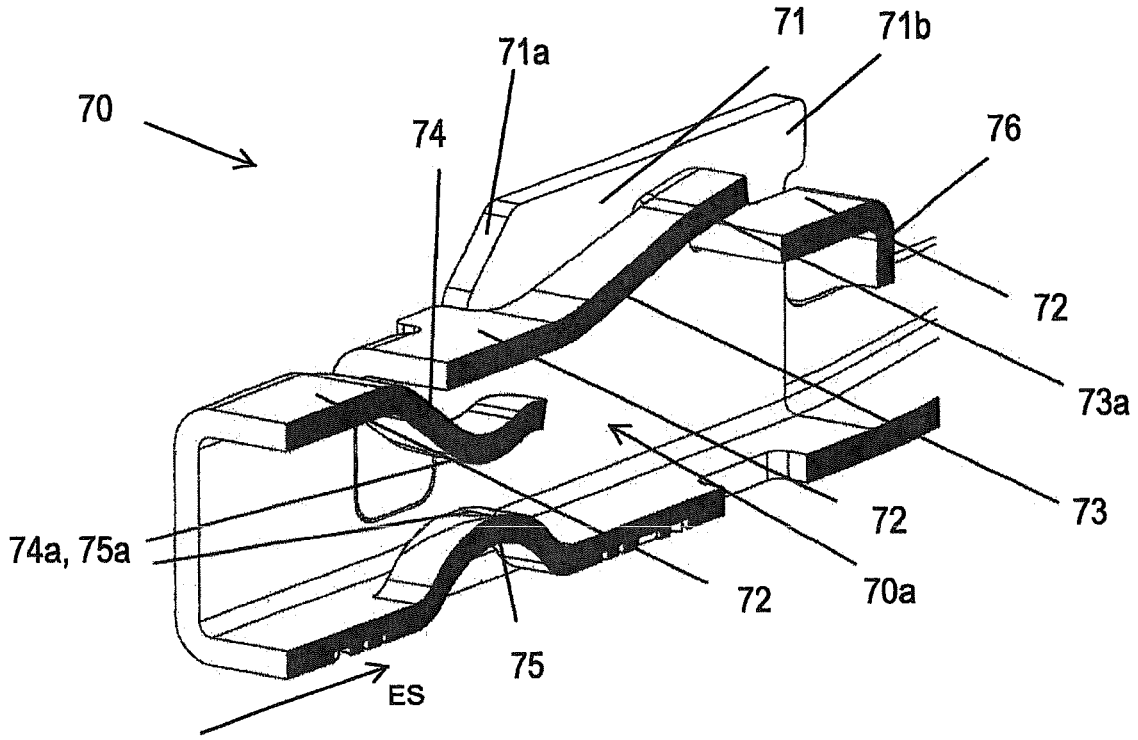

FIG. 9*b* illustrates the contact box 70 in the perspective sectional illustration as a detail from FIG. 9*a*. In the embodiment, integral functions are implemented in the closure tabs 72. The first closure tab 72 arranged in the insertion direction of the contact box plug ES is supplemented in one piece around the spring lip 74 with its contact surface 74*a* in the region of the cylindrical-section-shaped end region. The amounts of the spring lip 74 and its contact surface 74*a* are selected as less than the clearance of the receptacle space 70*a* for the contact box plug (not shown). This also applies for the width of the contact arch 75 with its contact surface 75*a*.

The second closure tab 72 arranged in the insertion direction of the contact box plug ES is supplemented in one piece and in the direction ES around the detent hook 73 with its detent hook head 73*a*.

The third closure tab 72 arranged in the insertion direction of the contact box plug ES is supplemented in one piece and in the direction ES around the stop 76.

Figure 10A:
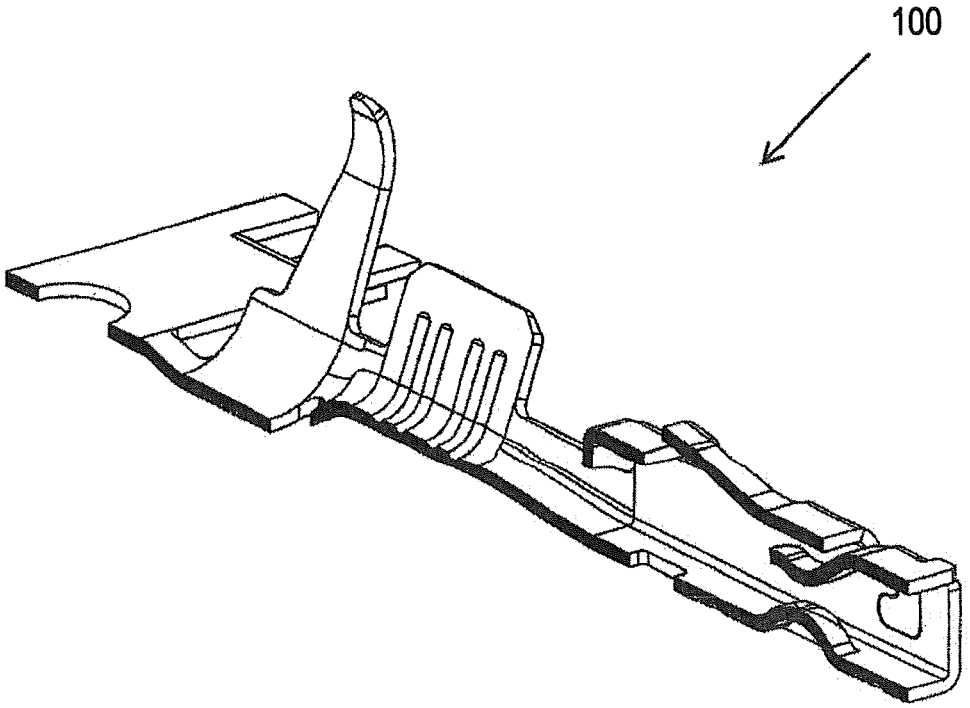
Figure 10B:
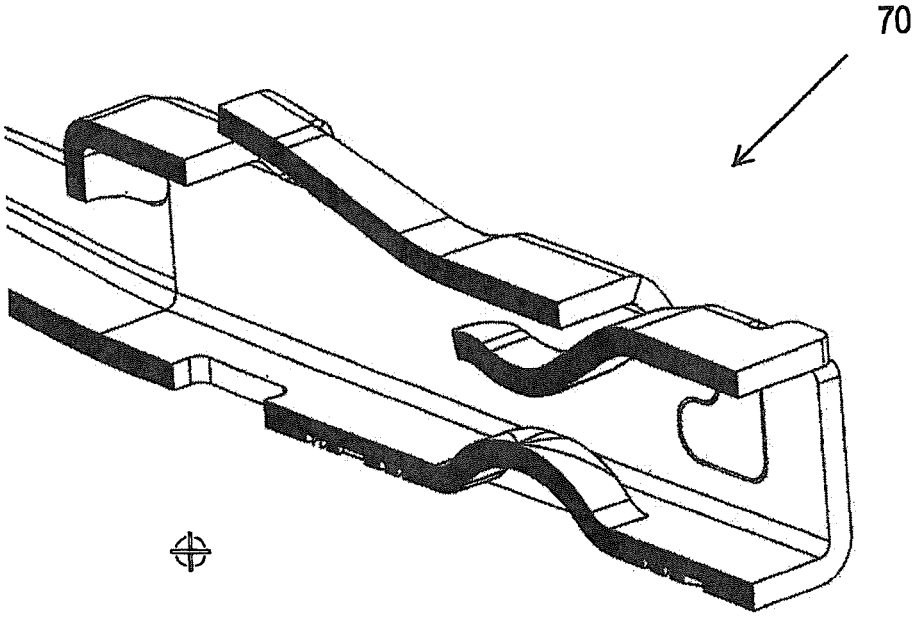

FIG. 10*a* comprises the second perspective sectional illustration of an exemplary embodiment of the socket contact element 100 and FIG. 10*b* comprises the contact box 70 in the perspective sectional illustration as a detail from FIG. 10*a*.

Figure 11A:
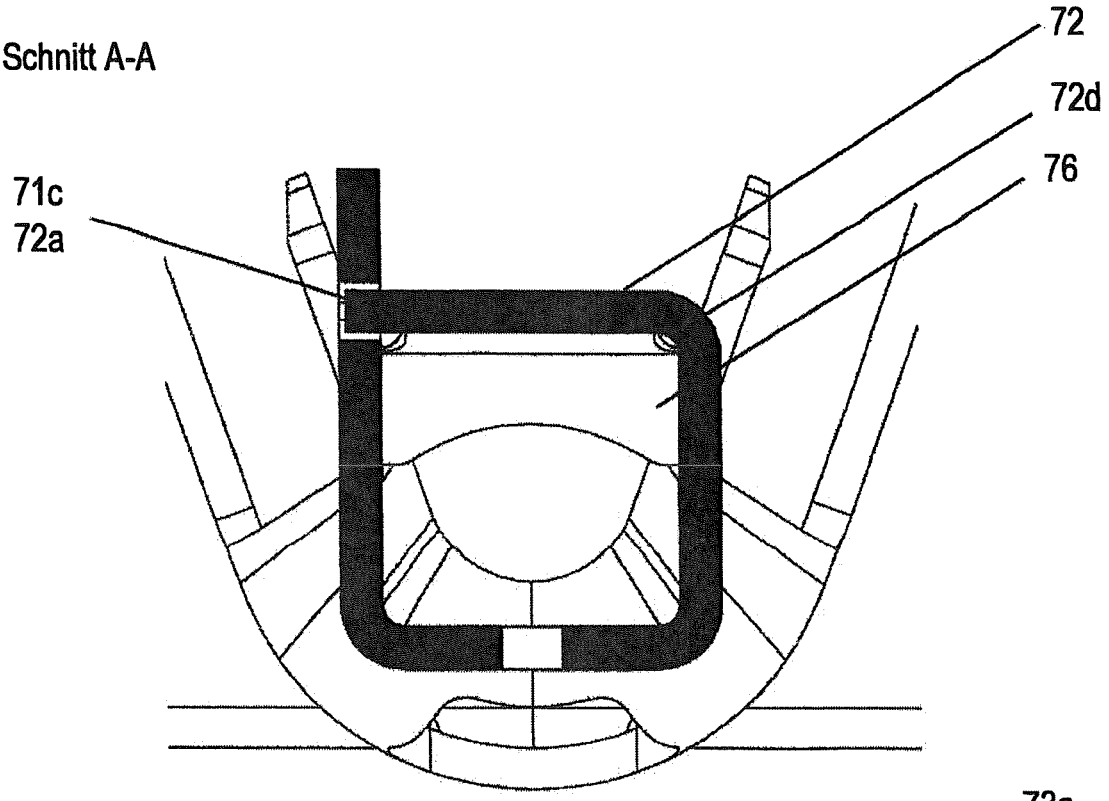

FIG. 11*a* shows the sectional illustration A-A of the contact box of the socket contact element 100 at the height of the closure lug 72*a* of the closure tab 72 with stop 76. The closure lug 72*a* engages in the bore 71*c* of the orientation lip 71 and practically functions as a buttress to the bending, bending hinge 72*d*, so that increased structural stability is supported.

Figure 11B:
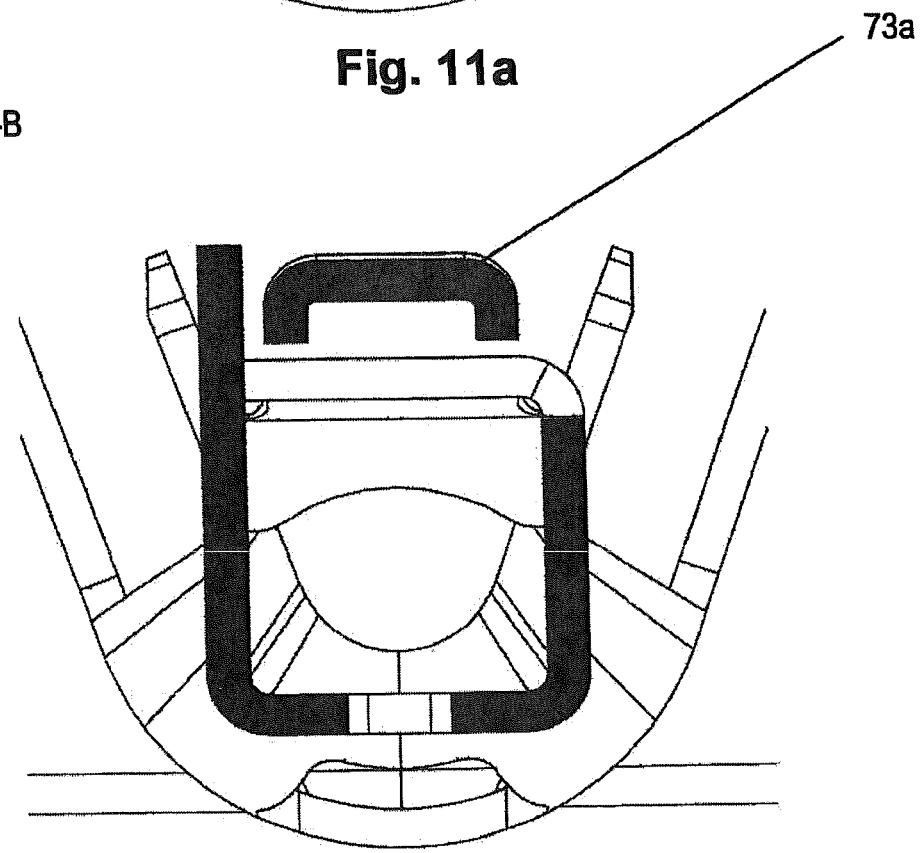

FIG. 11*b* comprises the sectional illustration B-B of the contact box 70 of the socket contact element 100 at the height of the detent hook head 73*a* of the detent hook 73.

Figure 12A:
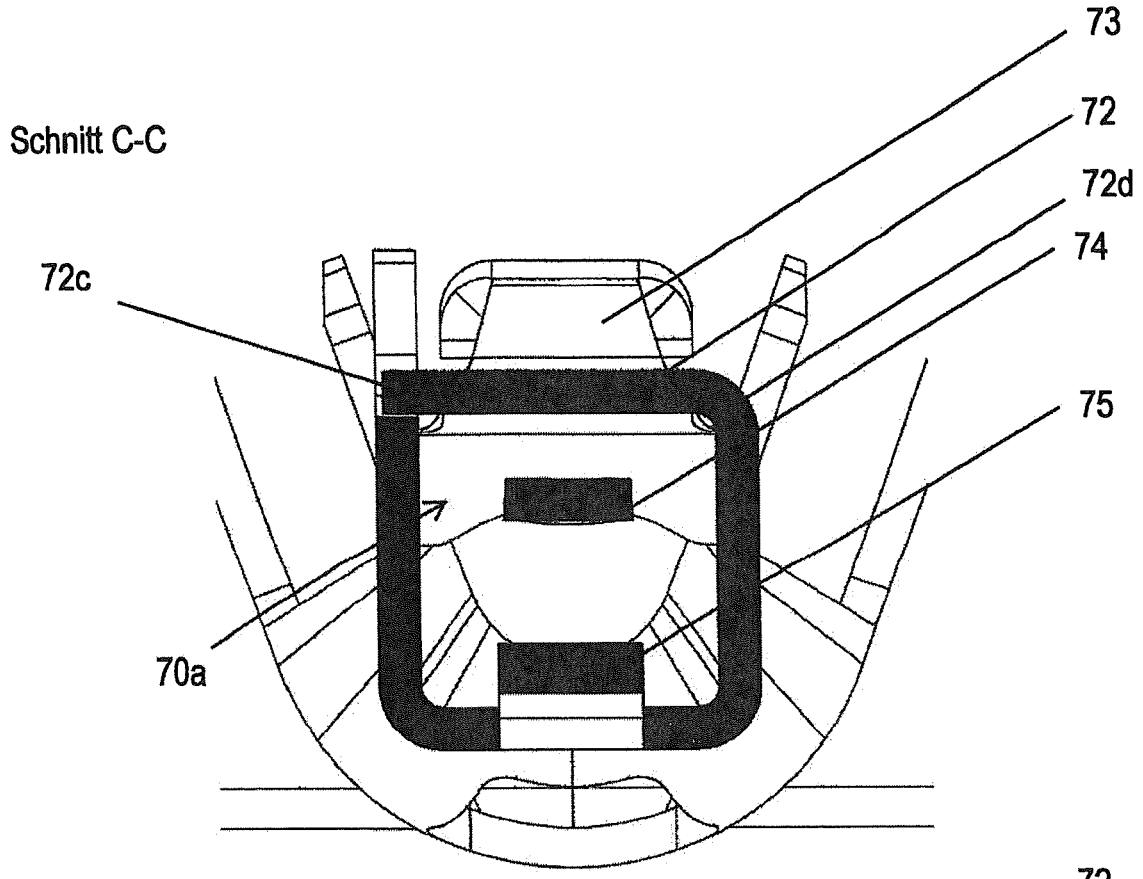

FIG. 12*a* shows the sectional illustration C-C of the contact box 70 of the socket contact element 100 at the height of the support lug 72*c* of the closure tab 72 with detent hook 73. The invention again uses the stability-increasing effect of the buttress formed by the support lug 72*c* with respect to the bending, bending hinge 72*d*. At this sectional height, the spring lip 74 and the contact arch 75 extend inside the receptacle space for the contact box plug 70*a*.

Figure 12B:
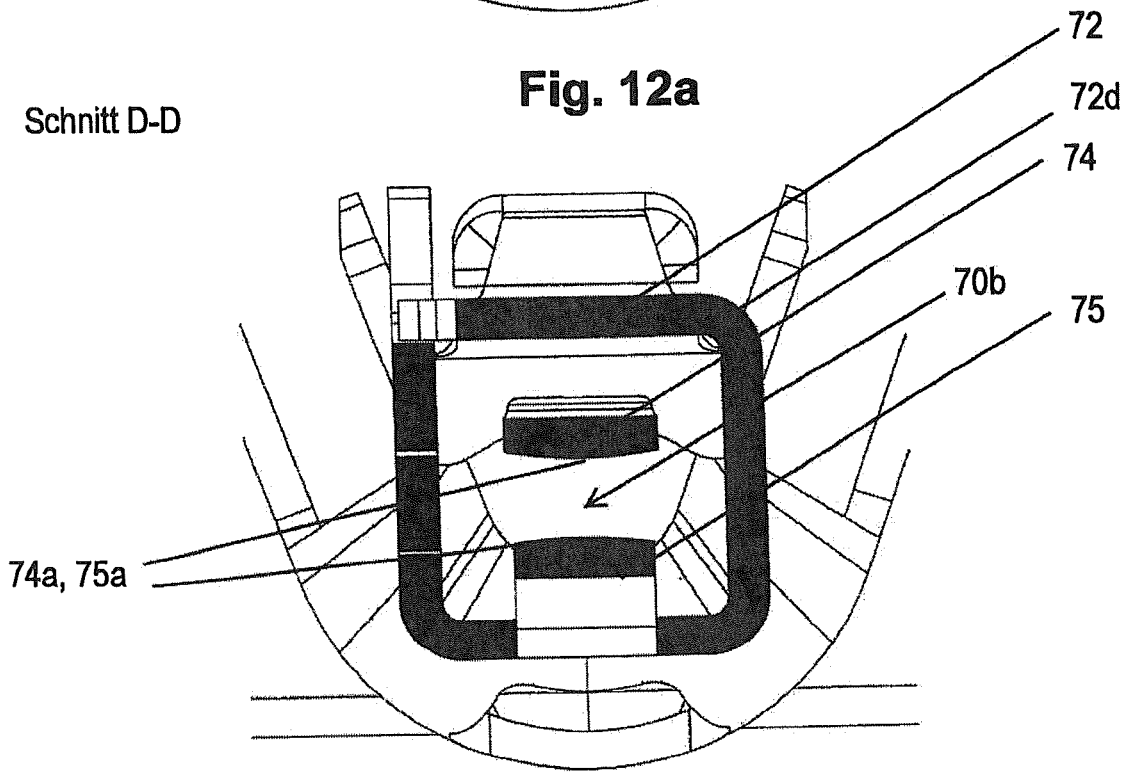

FIG. 12*b* depicts the sectional illustration D-D of the contact box 70 of the socket contact element 100 at the height of the closure tab 72 with contact zone 70*b*. The contact zone 70*b* is located in the region of the smallest clearance formed by the contact surfaces 74*a*, 75*a* of spring lip 74 and contact arch 75. The respective crowned contour of the contact surfaces 74*a*, 75*a* is shown here. This geometrically caused functional integration results in a shrunken contact area to the contact box plug (not shown), so that an increased surface pressure is produced with otherwise equal spring force of the spring lip 74.

Figure 13:
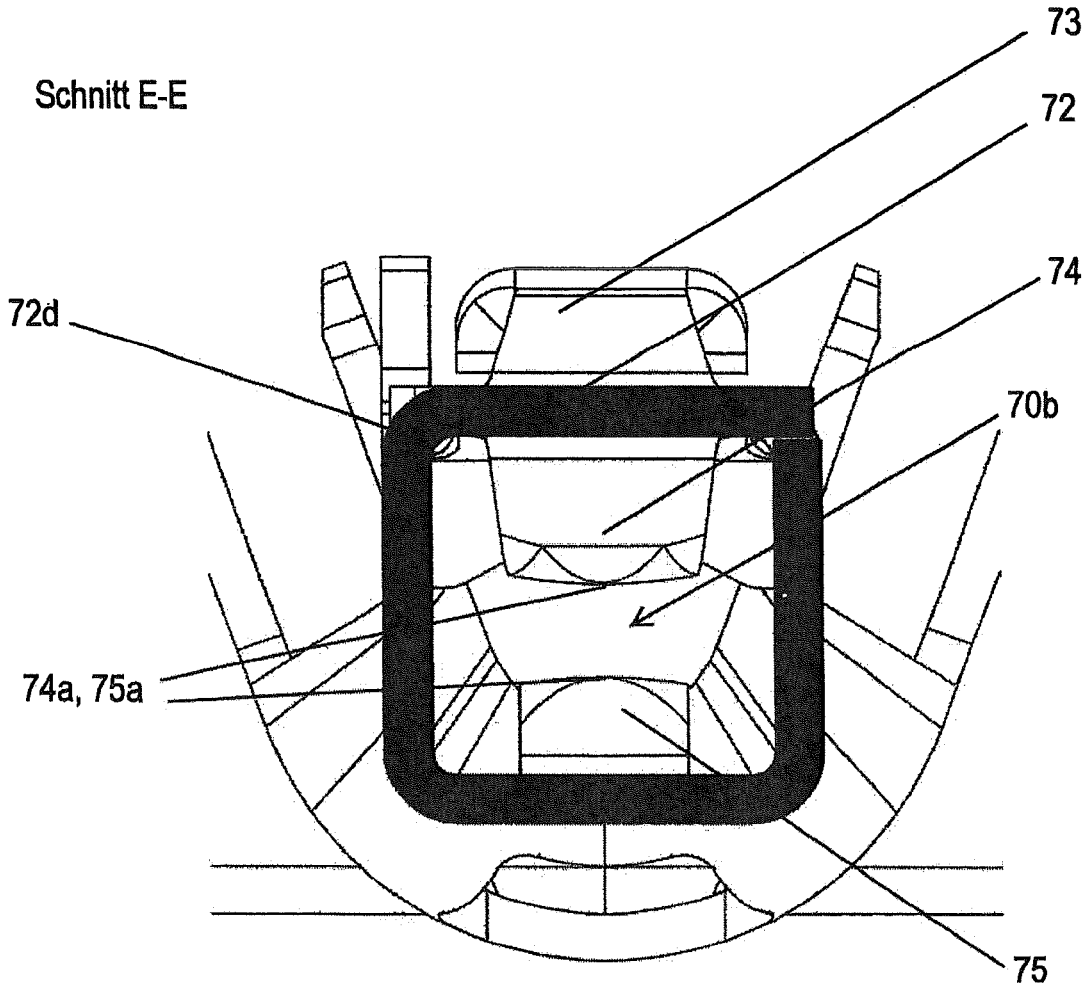
FIG. 13 shows the sectional illustration E-E of the contact box of the socket contact element at the height of the closure tab with spring lip.

FIG. 13 shows the sectional illustration E-E of the contact box 70 of the socket contact element 100 at the height of the closure tab 72 with spring lip 74. A left-side bend 72*d* of this closure tab 72 is shown, which is thus located opposite to the bend 72*d* of the closure tab 72 with detent hook 73 from FIGS. 12*a* and 12*b*. The invention recognizes that arranging opposing bends 72*d* is capable of assisting the one-piece production by forming from a semifinished product flat.

Figure 14:
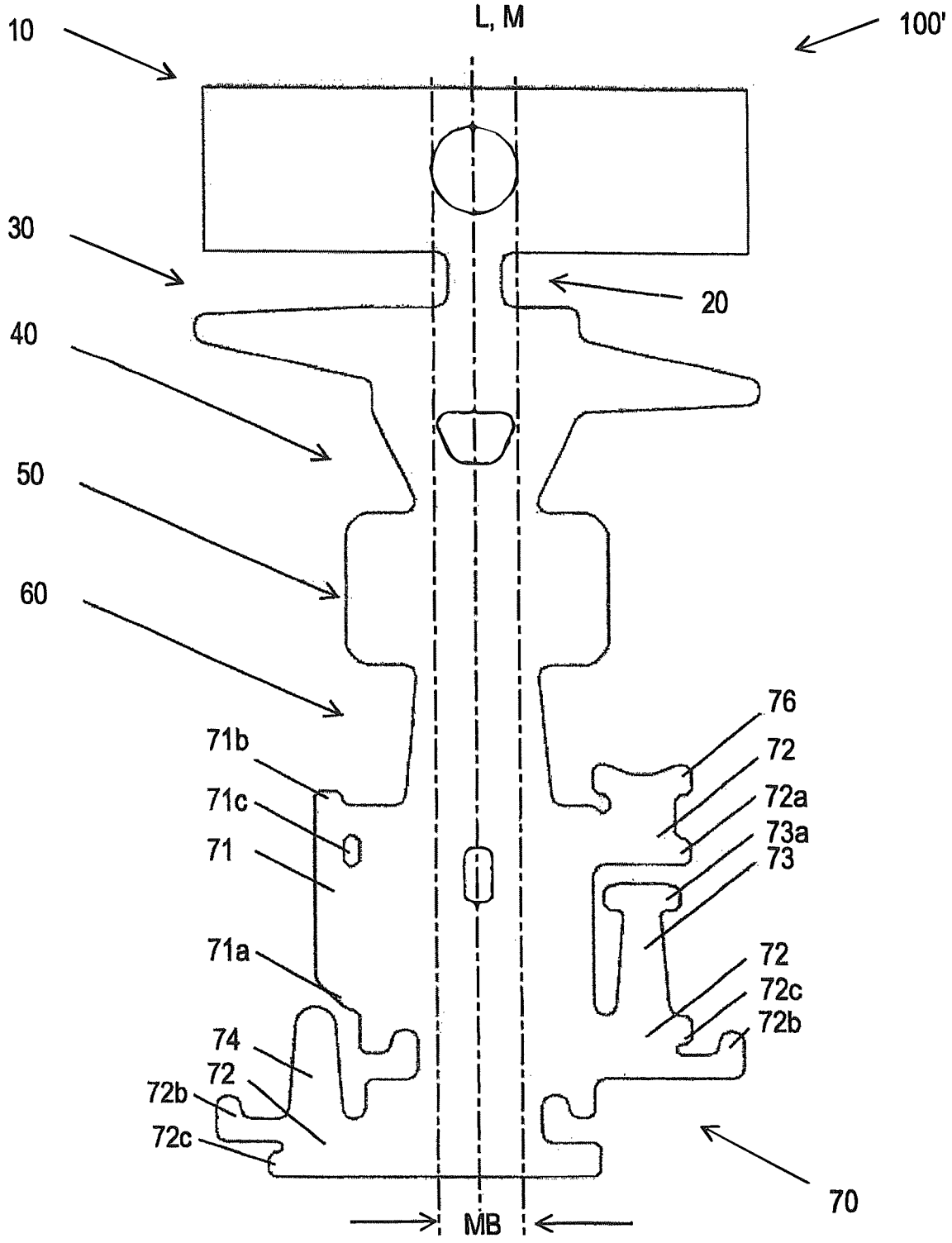
FIG. 14 shows the top view of a first example of the sheet-shaped, one-piece flat material as a semifinished product after a stamping process before the forming by bending, folding.

FIG. 14 shows the top view of a first example of the sheet-shaped, one-piece flat material 100' as a semifinished product after a stamping process before the forming by bending, folding. The contoured flat 100' is used after its preassembly as a starting material for the introduction of the crimp contour in the crimp section 50 and formation of the contact arch 75 in the later contact zone 70*b*. Massive forming measures are typically carried out for this purpose.

The deformation processes to form the socket contact element 100 can be roughly divided into three zones of the semifinished product flat 100':

The middle region MB in between and the two outer regions adjoining thereon.

The middle region MB is not or is only marginally deformed in the handling region 10 and in the region of the contact box 70, so that an essentially planar structure is obtained. In the other regions, a spherical or three-dimensional deformation takes place in different amounts, for example like a cylindrical section.

The respective outer regions can be the subject matter of bending measures, folding processes, or free deformations. In particular in the region of the contact box 70, bending and folding sequences can be provided in order to produce the locationally-correct positions of the detent hook 73 outside the later receptacle space 70*a* for the contact box plug and the spring lip 74 inside the later receptacle space 70*a* for the contact box plug. In the present exemplary embodiment, this means specifically that firstly the closure tab 72 with spring lip 74 is shaped into its final position by a first folding or bending process, followed by the forming process for the closure tab 72 with detent hook 73. The closure tab 72 with stop 76 is not subject to any required sequence and can be formed at any time out of the semifinished product sheet plane into the final position to form the contact box 70 of the socket contact element 100.

Figure 15:
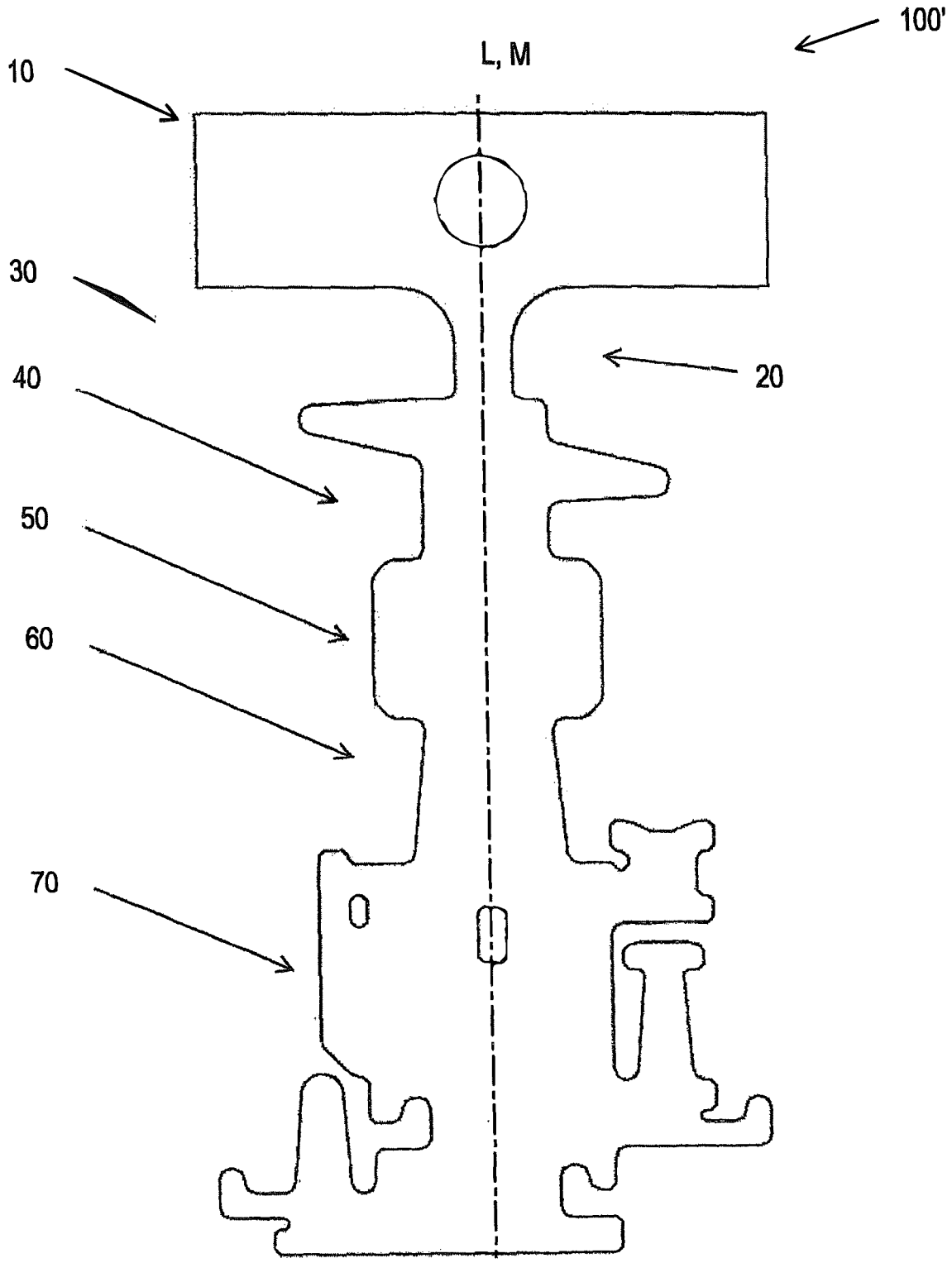
FIG. 15 shows the top view of a second example of the sheet-shaped, one-piece flat material as a semifinished product.

FIG. 15 illustrates the top view of a second example of the sheet-shaped, one-piece flat material 100'. While the geometrical formations of the contact box 70 are comparable to the situation depicted by FIG. 14, FIG. 15 shows a flat with a changed geometry in the first connecting section 20, insulation section 30, second connecting section 40, crimp section 50, and third connecting section 60.

LIST OF REFERENCE SIGNS

10 handling section
11 bore, eye
12 flat part in radial extension direction
13 notch
20 first connecting section
30 insulation section
31 receptacle space for line
40 second connecting section
50 crimp section
51 receptacle space for stripped line, core
60 third connecting section
70 contact box
70*a* receptacle space for contact box plug
70*b* contact zone
71 orientation lip
71*a* threading bevel, insertion chamfer
71*b* lug
71*c* bore
72 closure tab
72*a* closure lug
72*b* contoured closure lug
72*c* support lug
72*d* bend, bending hinge
73 detent hook
73*a* detent hook head
74 spring lip
74*a* contact surface
75 contact arch
75*a* contact surface
76 stop
100 socket contact element
100' semifinished product, flat
EK insertion direction of the contact box
ES insertion direction of the contact box plug
L longitudinal axis
M center axis
MB middle region

The invention claimed is:

1. A socket contact element for establishing an electrically conductive connection comprising:

a crimp section for establishing an electrically conductive connection to a line; and a contact box for establishing a detachable electrically conductive connection to a contact box plug, the contact box including a plurality of surfaces defining quadrilateral or rectangular box-like basic structure, wherein the socket contact element is constructed in one piece and includes a plurality of integrally implemented functions based on geometrical designs, and wherein the contact box is supplemented at one or more lateral surfaces among the plurality of surfaces by at least one closure tab that is formed as one piece and is integrally formed with the lateral surface, and wherein the contact box includes at least one detent hook which is configured to assist with locking in a receptacle bore of a contact carrier or multi-contact block, and wherein the at least one detent hook includes a head having wings protruding radially from the head, and wherein the at least one detent hook includes a detent hook end oriented against an insertion direction of the contact box.

2. The socket contact element as claimed in claim 1, wherein the socket contact element is supplemented by a handling section.

3. The socket contact element as claimed in claim 1, wherein the socket contact element includes an insulation section.

4. The socket contact element as claimed in claim 3, wherein the insulation section is arranged relative to the crimp section in such a way that a substantially linear arrangement of the core of the line to be received is assisted.

5. The socket contact element as claimed in claim 1, wherein the contact box has the quadrilateral or rectangular box-like basic structure, so that the contact box is insertable into a corresponding receptacle bore of a contact carrier or multi-contact block.

6. The socket contact element as claimed in claim 5, wherein the contact box has at least one orientation lip, which extends beyond the box-like structure of the contact box.

7. The socket contact element as claimed in claim 1, wherein the at least one closure tab is supplemented by a closure lug corresponding to at least one side wall of the contact box and/or a contoured closure lug, so that the structural integrity of the contact box is assisted.

8. The socket contact element as claimed in claim 7, wherein the contoured closure lug is formed against the insertion direction of the contact box and engages in a corresponding recess inside the contact box.

9. A socket contact element as claimed in claim 7, wherein the at least one closure tab includes a first closure tab supplemented by a first contoured closure lug configured to couple with a first side wall of the contact box, and a second closure tab supplemented by a second closure lug configured to couple with a second side wall of the contact box opposite the first side wall.

10. The socket contact element as claimed in claim 1, wherein the contact box encloses an interior, at least in one region, so that a receptacle space is formed for a contact box plug and/or a contact zone.

11. The socket contact element as claimed in claim 1, wherein the at least one detent hook is formed in one piece with a closure tab.

12. A sheet-shaped semi-finished product for producing a socket contact element as claimed in claim 1, wherein the semi-finished product material is electrically conductive and can be formed, so that the socket contact element is formed by bending and/or folding and/or three-dimensional forming.

13. A sheet-shaped semi-finished product for producing a socket contact element as claimed in claim 12, wherein the boundary and contour of the semi-finished product assist the geometrical design of the socket contact element after the forming thereof.

14. A method for producing a socket contact element as claimed in claim 1, from a semi-finished product by three-dimensional forming and/or folding and/or bending.

* * * * *